United States Patent [19]

Saito et al.

[11] Patent Number: 4,615,373

[45] Date of Patent: Oct. 7, 1986

[54] METHOD AND AN APPARATUS FOR MANUFACTURING A HOLLOW STEEL INGOT

[75] Inventors: Kenji Saito; Kyoji Nakanishi, both of Chiba; Akihiko Nanba; Masayuki Onishi, both of Kurashiki; Minoru Yao; Toshio Kato, both of Kurashiki; Shinji Kojima, Kurashiki, all of Japan

[73] Assignee: Kawaski Steel Corporation, Kobe, Japan

[21] Appl. No.: 771,213

[22] Filed: Aug. 30, 1985

[30] Foreign Application Priority Data

Sep. 3, 1984 [JP] Japan ..... 59-182753

[51] Int. Cl.[4] ..... B22D 27/04

[52] U.S. Cl. ..... 164/125; 164/348; 164/369

[58] Field of Search ..... 164/348, 125–128, 164/369

[56] References Cited

U.S. PATENT DOCUMENTS 4,278,124 7/1981 Aso et al. ..... 164/348 X

*Primary Examiner*—Kuang Y. Lin

*Attorney, Agent, or Firm*—Balogh, Osann, Kramer, Dvorak, Genova & Traub

[57] ABSTRACT

A method and an apparatus for manufacturing a hollow steel ingot are disclosed, which comprise coaxially arranging a cylindrical metallic core in a center of a mold and pouring molten steel into an annular casting space defined between the core and the mold to cool and solidify it. In this case, the core is constructed with a concentric double tube consisting of inner tube and outer tube and receives in its central portion a cooling gas tank provided at the outer peripheral surface with plural outlets opening toward the inner peripheral surface of the inner tube. An inert gas is flowed through an annular gap defined between the inner tube and the outer tube, while a cooling gas is blown toward the inner peripheral surface of the inner tube.

5 Claims, 5 Drawing Figures

METHOD AND AN APPARATUS FOR MANUFACTURING A HOLLOW STEEL INGOT

BACKGROUND OF THE INVENTION

1. Field of the Invention

This invention relates to a stock or hollow metal ingot used in the production of cylindrical forged steel articles such as pressure vessel, oversized ring material and the like, and more particularly to a method and an apparatus for manufacturing a hollow steel ingot.

2. Related Art Statement

As a method for manufacturing a hollow steel ingot for use in the production of cylindrical forged steel articles and the like, there have been proposed a method in which a solid core made of metal or sand is coaxially set in a hollow cylindrical mold and molten steel is poured into an annular casting space between the mold and the core by top or bottom pouring process to cool and solidify it, a method of manufacturing a hollow steel ingot by centrifugal casting technique, which is entirely differend from the above, and so on. However, these methods have such problems that the arrangement of the core is complicated, the surface condition of the steel ingot is poor, molten steel at the side of the core is insufficiently cooled to cause a large segregation, and the like. As a result, hollow steel ingots to be sufficiently satisfied have not yet been obtained.

As a technique for solving the above problems, there has recently been proposed a method of manufacturing the hollow steel ingot wherein the ingot is constructed of a metallic cylinder used as an outer tube contacting with molten metal and a hollow or solid metal arranged inside the cylinder, and a cooling medium, such as air, water vapor or the like is flown therebetween (British Pat. No. 520598). Further, there has been proposed in Japanese Patent laid open No. 54-117,326 a method of manufacturing the hollow steel ingot, wherein a core constructed of a cylindrical steel tube and a cylindrical refractory member contacting with the inner wall of the steel tube is arranged in the center of the mold mounted on a stool, and molten metal is poured into the gap between the mold and the core.

These well-known methods make the arrangement of the core simple and improve the cooling of molten steel near the core, and consequently a lot of problems have been solved. However, for example, in the technique proposed in British Pat. No. 520598, there is a fear that the metallic outer tube contacting with molten steel is burned-out by molten steel flow in the pouring of molten steel. Once it is burned-out, molten steel is penetrated into the core, which makes the use of resulting hollow steel ingot impossible. On the other hand, if the thickness of the metallic outer tube is increased or the cooling is strengthened, cracks are produced over the inner surface of steel ingot due to the application of stress to the solidified shell in the solidification shrinkage of molten steel. The crack produced over the inner surface of the hollow steel ingot is unfovarable because it adversely affects products after the forging. Although it is certainly effective to use water, steam, liquid metal or the like in order to increase the cooling of the core, not only the equipment becomes complicated, but also the operation is very difficult. While, if a gas which is simply available is used as a cooling medium, the sufficient cooling is not still obtained in the well-known ordinary technique.

And also, the technique disclosed in Japanese Patent laid open No. 54-117,326 has such characteristics that cracks due to solidification shrinkage are not produced over the inner surface of the steel ingot, and even if the cylindrical steel tube is burned-out, the core has no problem in the structure and can simply be taken out after the solidification of molten steel, which solve many problems included in the conventional method of manufacturing hollow steel ingots. In this technique, however, the inverse V-shaped segregation produced in the steel ingot is not completely overcome, so that there may be still caused a problem that the inverse V-shaped segregation lines are produced on the inner surface of a product in the machining after the forging to spoil the quantity of the product.

In short, it is a main cause of these problems that the products produced from the hollow steel ingot recently become larger and the quality thereof is required to be higher. In practice, the problems included in the above prior art are fatal and it is practically difficult to manufacture hollow steel ingots of desired high quality and large size.

SUMMARY OF THE INVENTION

It is an object of the invention to overcome the above mentioned problems and to provide a technique capable of manufacturing a large-sized hollow steel ingot having a high quality.

According to a first aspect of the invention, there is the provision of in a method for manufacturing a hollow steel ingot, particularly a hollow steel ingot of high quality and large size by coaxially arranging a cylindrical metallic core in a center of a mold and pouring molten steel into an annular casting space defined between the core and the mold to cool and solidify it, the improvement wherein said core is constructed with a concentric double tube consisting of inner tube and outer tube, and cooled by flowing an inert gas through an annular gap defined between the inner tube and the outer tube and blowing a cooling air toward the inner peripheral surface of the inner tube, and under such cooling conditions for the core, molten steel is poured so that the product of the rise rate of molten steel and the overheating temperature of molten steel in the pouring is equal to or larger than 7,000 (mm·°C./min).

According to a second aspect of the invention, there is the provision of in an apparatus for manufacturing a hollow steel ingot by coaxially arranging a cylindrical metallic core in a center of a mold and pouring molten steel into an annular casting space defined between the core and the mold to cool and solidify it, the improvement wherein said core is constructed with a concentric double tube consisting of inner tube and outer tube and receives in its central portion a cooling gas tank provided with plural cooling gas outlets opened toward the inner peripheral surface of the inner tube, and plural inert gas outlets each connected to an inner gas supply pipe are arranged in the lower portion of the inner tube so as to open toward an annular gap defined between the inner tube and the outer tube.

In this apparatus, a reinforcing plate is arranged outside the lower portion of the outer tube of the core so as to prevent the burn-out of the outer tube.

DETAILED DESCRIPTION OF THE INVENTION

Figure 1:
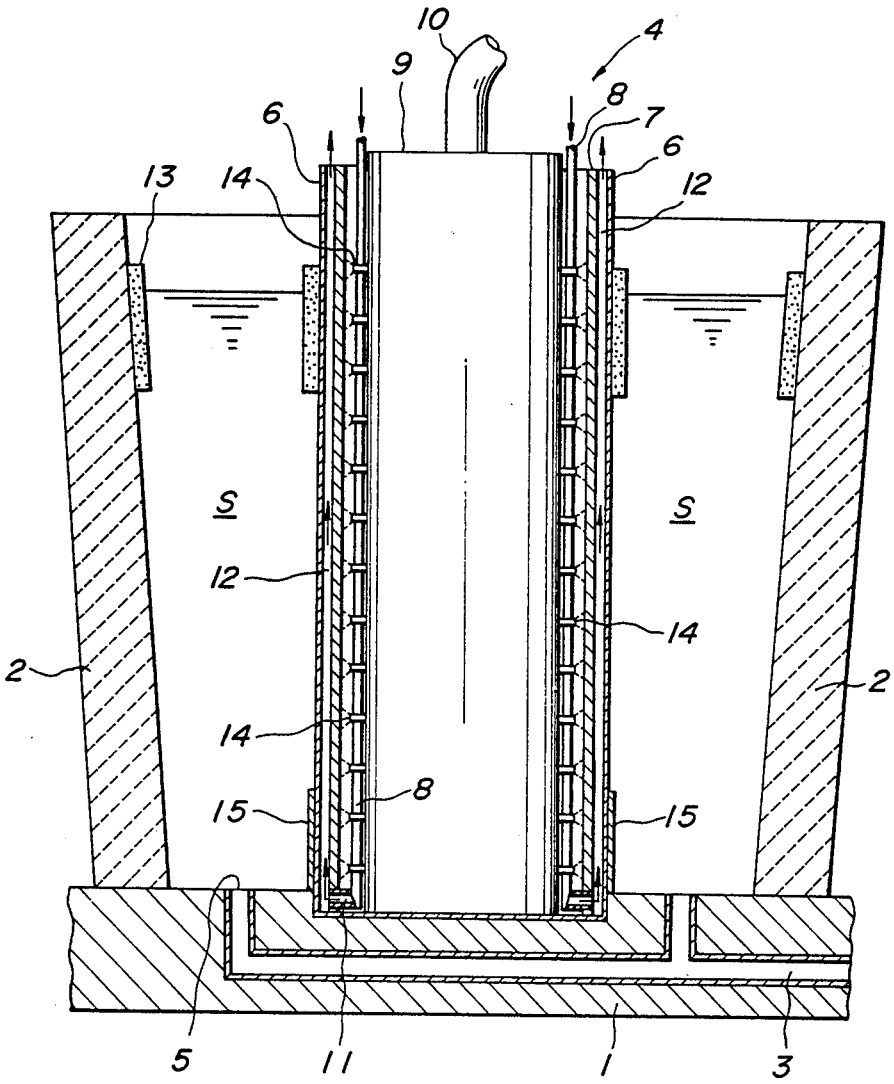
FIG. 1 is a sectional view of an embodiment of the apparatus according to the invention.

According to the invention, the core has a concentric double tube structure consisting of the inner and the outer tubes and the reinforcing plate is arranged outside the lower portion of the outer tube, which are a technique for preventing such a situation that the outer tube of the core is burned out by the flow of molten steel with a high overheating temperature, which is introduced from a sprue provided in a stool into the casting space, during the pouring and hence it is substantially impossible to manufacture a hollow steel ingot.

The height of the reinforcing plate arranged on the outer tube facing the casting space is variably adjusted by the distance from the spure to the outer tube of the core and the flow rate of molten steel from the sprue.

Into the annular gap defined between the outer tube and the inner tube of the core is upwardly flowed an inert gas such as nitrogen or argon supplied from the lower portion of the inner tube to cool the inner tube and the outer tube. In this case, the reason why the inert gas such as nitrogen or argon gas is used as a gas passing through the annular gap is due to the consideration for preventing a fear that the temperature of the outer tube contacting with molten steel temporarily becomes higher so that the outer tube is burned out by an oxidative heat occasionally generated when using an oxidizing gas such as air or the like.

The outer tube has such a thickness that it is properly deformed in the solidification shrinkage of molten steel so as not to produce cracks over the inner surface of the hollow steel ingot. On the other hand, the inner tube has a suitable thickness for supporting molten steel and keeping a given hollow configuration even if the outer tube is burned out. The size of the annular gap between the outer tube and the inner tube is determined to be not more than allowable deformation amount of the outer tube. Although the thickness of the outer tube is selected to make its deformation easy, there is still a risk of burn-out. For the prevention of the burn-out, the lower portion of the outer tube is made a double structure using the above reinforcing plate, but there must occasionally be the provision against the occurrence of the burn-out. Therefore, the thickness of the inner tube, the cooling conditions and the size of the annular gap are so selected that even if the outer tube is deformed of molten steel flows into the annular gap in the burn-out of the outer tube, the inner tube supports molten steel to solidify it.

In addition, the similar annular gap is provided between the inner tube and the cooling gap tank for a cooling gas (air reservoir) so as to blow the cooling air from the cooling gas tank toward the inner peripheral surface of the inner tube. The cooling gas tank is provided at the top with a cooling gas inlet and at the side (outer peripheral surface) with plural air outlets. The jetting direction of the cooling air from the air outlets is determined to be at a right angle with respect to the inner peripheral surface of the inner tube. The reason why the cooling air is jetted at such an angle is due to the consideration for making the cooling effect of the inner tube largest.

Figure 2:
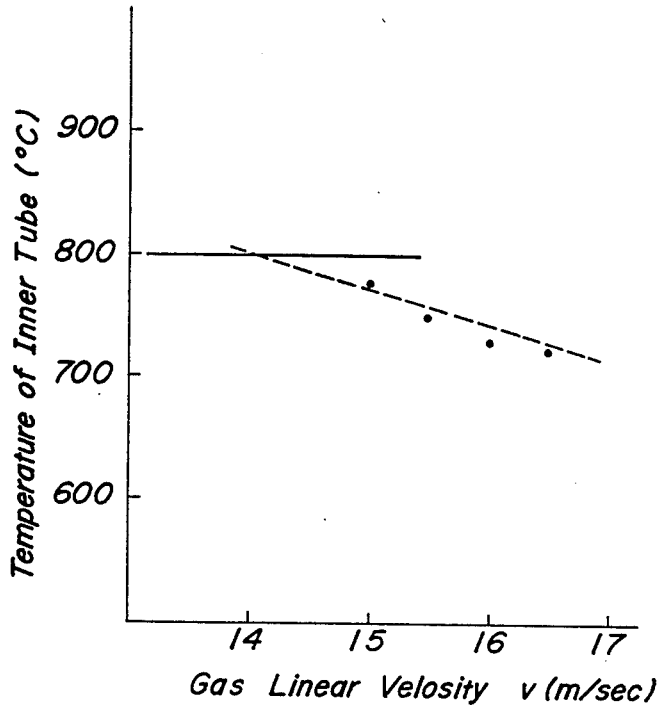
FIG. 2 is a graph illustrating a relation between the gas linear velocity and the temperature of the inner tube.

Such an inner tube must keep a predetermined strength in order to control the deformation of the outer tube below a given amount and to cool and solidify molten steel flowing in the burn-out. In general, it is known that the high temperature strength of steel varies with the rise of the temperature and the ductility is lowered due to $\alpha \rightarrow \beta$ transformation above about 800° C. Accordingly, in order to maintain the strength of the inner tube, it must be so cooled that the temperature of the inner tube is always not more than 800° C. As a result of experiments on the manufacture of many hollow steel ingots, it has been found that the gas linear velocity of the inert gas flowing through the annular gap between the inner tube and the outer tube is related to the surface temperature of the inner tube as shown in FIG. 2. That is, it is understood that the relation between the gas linear velocity (v) converted to normal condition (0° C., 1 atom) and the surface temperature of the inner tube is substantially linear and the gas linear velocity v is sufficient to be not less than 14 m/sec in order to restrict the temperature of the inner tube to not more than 800° C.

Usually, in case of the casting of the steel ingot, there is naturally attempted to prevent a porosity defect or a segregation. In this connection, it is well-known that a feeder head is effective on the decreases of porosity defect and segregation. Particularly if it is intended to make the cooling of the core large as in the invention, in order to prevent the porosity defect and the segregation, it is required that an exothermic or insulated sleeve is arranged at a level corresponding to the molten metal surface.

Figure 3:
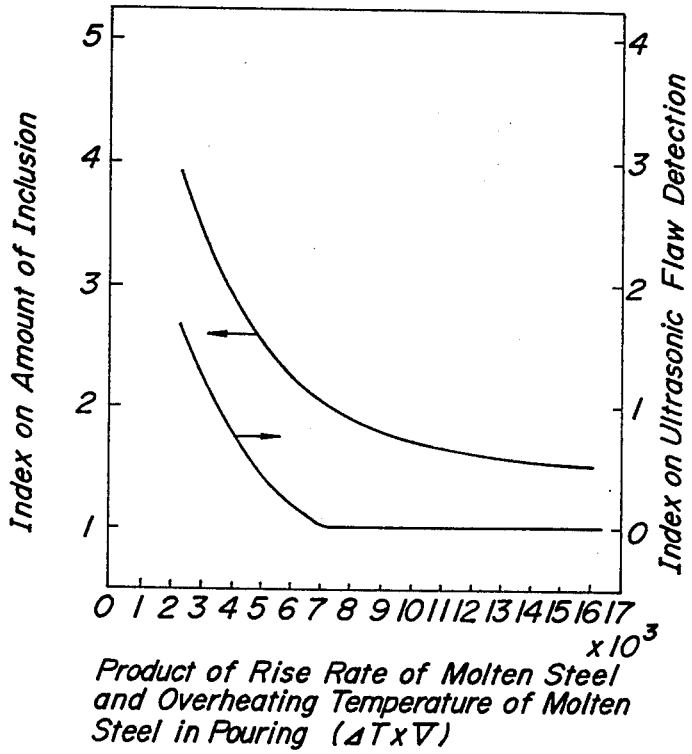
FIG. 3 is a graph illustrating a relation between the product of the rise rate and the overheating temperature in molten steel and the index of inclusion in the steel ingot.

And also, as one of the matters that demand special attention in the manufacture of oversized steel ingots, mention may be made of the reduction of inclusion in the steel ingot. Since the presence of the inclusion remarkably spoils the product quality, it is required to attempt the reduction of the inclusion even in the manufacture of the hollow steel ingot as in the invention. In this connection, the inventors have found that the product of the rise rate V (mm/min) of molten steel and the overheating temperature $\Delta T$ (°C.) of the molten steel in the puring is clearly related to the amount of inclusion in the steel ingot as shown in FIG. 3 and harmful inclusion rapidly decreases within a range of $V \times \Delta T \geqq 7{,}000$ (mm·°C./min). Although the increase in the rise rate V or the overheating temperature $\Delta T$ of molten steel is unfavorable up to now due to the increase of such a risk that the outer tube contacting with molten steel is burned out, when the above core structure according to the invention is employed, it is possible to perform such a process.

FIG. 1 shows a sectional view of the apparatus according to the invention, wherein numeral 1 is a stool comprising one or more up sprues 5 opened toward an annular casting space S in a mold 2, and a runner 3. Numeral 4 is a core according to the invention, which has a concentric double tube structure consisting of an outer tube 6 and an inner tube 7. A cooling gas tank 9 is housed in the inner tube 7. In the gap between the inner tube 7 and the cooling gas tank 9 are set plural supplying pipe 8 for an inert gas at given intervals, each of which is provided at its lower end portion with an outlet 11 opening toward an annular gap 12 defined between the inner and the outer tubes 6, 7. The cooling gas tank 9 is provided at its top with an inlet 10 for introducing a cooling gas such as air or the like. And also, the cooling gas tank 9 is provided at the outer peripheral surface with plural outlets 14, through which the cooling gas is jetted in a direction perpendicular to the inner peripheral surface of the inner tube 7, whereby the inner tube 7 is cooled by air. Numeral 13 is an insulated sleeve and numeral 15 is a reinforcing plate, which are utilized for protecting the outer tube 6 from the poured molten steel.

EXAMPLE

A hollow steel ingot of 200 tons in weight and 1,150 mm in average thickness was manufactured by bottom pouring as follows. The composition of the poured molten steel was C: 0.17%, Si: 0.21%, Mn: 1.45%, Ni: 0.74%, Cr: 0.15%, Mo: 0.52% and the remainder being iron and inevitable several elements.

On a stool having three sprues was arranged a chrysantemum type mold, in the central portion of which were disposed an outer tube of mild steel having an outer diameter of 1,400 mm and an inner diameter of 1,370 mm, an inner tube of mild steel having an outer diameter of 1,330 mm and an inner diameter of 1,270 mm, and a cooling gas tank having an outer diameter of 1,016 mm and an inner diameter of 1,000 mm, respectively. A nitrogen gas was continuously flowed into an annular gap between the inner tube and the outer tube at a rate of 50 $Nm^3$/min for about 30 hours from the beginning of the pouring, while air was continuously flowed from the cooling gas tank into a gap between the inner tube and the tank at a rate of 100 $Nm^3$/min for about 30 hours from the beginning of the pouring. The side wall of the cooling gas tank was provided with 350 air outlets of 6 mm in diameter, through which air was jetted in a direction perpendicular to the inner peripheral surface of the inner tube. Molten steel of 1,590° C. was casted at a rise rate of 145 mm/min with maintaining an overheating temperature of 77° C.

Although the outer tube adhered to the inner surface of the resulting steel ingot, there was no burn-out and the deformation was slight at the double structural (reinforcing plate) portion ranging from the bottom of the outer tube up to a distance of 80 cm, while a proper deformation was seen at a position of 1.2 m distant from the bottom of the outer tube. When the steel ingot was subjected to forging and machining, there was no improper portion as a product.

Figure 4A:
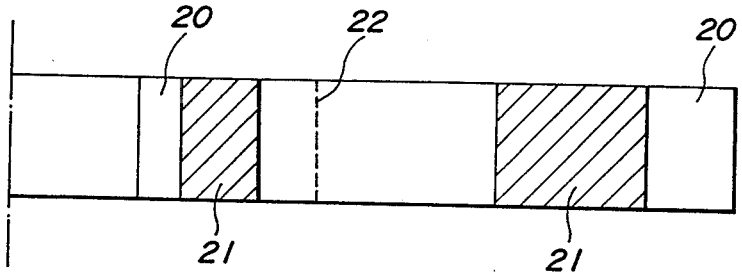
FIG 4a PRIOR ART
FIGS. 4*a* and 4*b* are schematic views illustrating a macrostructure of a hollow steel ingot obtained just beneath the feeder head for the comparison of the invention with the prior art, respectively.
Figure 4B:
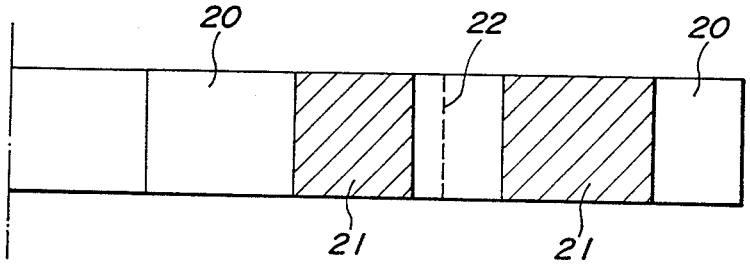

A sample was taken out from the steel ingot just beneath the feeder head to examine the macrostructure with respect to soundless portion (20), inverse V-shaped segregation producing portion (21) and final solidification position (22), and consequently the result as shown in FIG. 4*b* was obtained. It is clear that the method of the invention as shown in FIG. 4*b* is superior to the conventional method as shown in FIG. 4*a*.

According to the invention, as mentioned above, since the influence of the inverse V-shaped segregation line can be held at minimum, hollow steel ingots of large size and high quality can surely be obtained without complicating the apparatus, particularly the structure of core and the cooling means and causing trouble due to the burn-out, and consequently it is effective to cheaply manufacture hollow steel ingots.

What is claimed is:

1. In a method for manufacturing a hollow steel ingot by coaxially arranging a cylindrical metallic core in a center of a mold and pouring molten steel into an annular casting space defined between the core and the mold to cool and solidify it, the improvement wherein said core is constructed with a concentric double tube consisting of inner tube and outer tube, and cooled by flowing an inert gas through an annular gap defined between the inner tube and the outer tube and blowing a cooling air toward the inner peripheral surface of the inner tube, and under such cooling conditions for the core, molten steel is poured so that the product of the rise rate of molten steel and the overheating temperature of molten steel in the pouring is equal to or larger than 7,000 (mm·°C./min).

2. The method according to claim 1, wherein said innert gas is nitrogen or argon gas.

3. The method according to claim 1, wherein said inner gas is flowed at a gas linear velocity of not less than 14 m/sec to hold said inner tube at a temperature of not more than 800° C.

4. In an apparatus for manufacturing a hollow steel ingot by coaxially arranging a cylindrical metallic core in a center of a mold and pouring molten steel into an annular casting space defined between the core and the mold to cool and solidify it, the improvement wherein said core is constructed with a concentric double tube consisting of inner tube and outer tube and receives in its central portion a cooling gas tank provided with plural cooling gas outlets opened toward the inner peripheral surface of the inner tube, and plural inert gas outlets each connected to an inert gas supply pipe are arranged in the lower portion of the inner tube so as to open toward an annular gap defined between the inner tube and the outer tube.

5. The apparatus according to claim 4, wherein a reinforcing plate is arranged outside the lower portion of the outer tube of said core.

* * * * *